US006849003B2

(12) United States Patent
Kumamoto

(10) Patent No.: US 6,849,003 B2
(45) Date of Patent: Feb. 1, 2005

(54) GOLF CLUB HEAD

(75) Inventor: Tomio Kumamoto, Kobe (JP)

(73) Assignee: Sumitomo Rubber Industries, Ltd., Kobe-shie (JP)

( * ) Notice: Subject to any disclaimer, the term of this patent is extended or adjusted under 35 U.S.C. 154(b) by 0 days.

(21) Appl. No.: 10/650,982

(22) Filed: Aug. 29, 2003

(65) Prior Publication Data

US 2004/0053705 A1 Mar. 18, 2004

(30) Foreign Application Priority Data

Aug. 29, 2002 (JP) ..... 2002-251439

(51) Int. Cl.[7] ..... A63B 53/02; A63B 53/04; A63B 53/06; A63B 53/08

(52) U.S. Cl. ..... 473/305; 473/332; 473/347; 473/349

(58) Field of Search ..... 473/324, 332, 473/347, 349

(56) References Cited

U.S. PATENT DOCUMENTS 4,545,580 A * 10/1985 Tomita et al. ..... 473/332
4,778,185 A * 10/1988 Kurokawa ..... 473/332
4,824,110 A * 4/1989 Kobayashi ..... 473/332
4,874,171 A * 10/1989 Ezaki et al. ..... 473/290
5,007,643 A * 4/1991 Okumoto et al. ..... 473/346
5,242,168 A * 9/1993 Aizawa ..... 473/332
5,288,070 A * 2/1994 Chen ..... 473/331
5,344,689 A * 9/1994 Ide et al. ..... 428/114
5,350,556 A * 9/1994 Abe et al. ..... 264/248
5,445,382 A * 8/1995 Pearce et al. ..... 473/342
5,516,107 A * 5/1996 Okumoto et al. ..... 473/346

FOREIGN PATENT DOCUMENTS

JP 11-137734 A 5/1999
JP 11-169493 A 6/1999

* cited by examiner

*Primary Examiner*—Gregory Vidovich
*Assistant Examiner*—Alvin A. Hunter, Jr.
(74) *Attorney, Agent, or Firm*—Birch, Stewart, Kolasch & Birch, LLP

(57) ABSTRACT

A golf club head made of a fiber reinforced resin, comprising: a face hitting a ball; a crown forming an upper surface of the head; a sole forming a bottom surface of the head; a side extending between the crown and the sole from an edge on a toe side of the face to an edge on a heel side through a back face; and a hosel into which a shaft is inserted, wherein the crown has a thickness of equal to or less than 2.2 mm, and includes at least partially a high elastic part made of a fiber reinforced resin reinforced by at least one kind of fiber having a tensile elasticity modulus between 380 and 900 (GPa), and the hosel is provided with a vibration absorbent having a loss tangent between 0.7 and 1.5 at a temperature of 10° C. in the vicinity thereof.

9 Claims, 8 Drawing Sheets

GOLF CLUB HEAD

This nonprovisional application claims priority under 35 U.S. C. § 119(a) on Patent Application No(s). 2002-251439 filed in JAPAN on Aug. 29, 2002, which is (are) herein incorporated by reference.

BACKGROUND OF THE INVENTION

1. Field of the Invention

The present invention relates to a golf club head employing a fiber reinforced resin.

2. Description of the Related Art

In recent years, for example, a golf club head of a wood club frequently employs a metal material such as a titanium alloy and a stainless steel. This kind of head generally has a high ball hitting sound. As a result of various researches, it has been found that such a high ball hitting sound gives an impression that the ball well flies to a player. However, in the case that the ball is hit at a position deflecting from a sweet spot, that is, a so-called off center impact is performed, a vibration and an impact are transmitted to arms of the player via a shaft sensitively in the metal head, so that there is a disadvantage that a ball hitting feeling is poor.

On the other hand, in a conventional persimmon head and a carbon head made of a carbon fiber reinforced resin or the like, since vibration absorbability is high in comparison with the case of the metal material, the vibration is hard to be transmitted to the arms of the player even at the off center impact, and a good ball hitting feeling can be obtained. In particular, the carbon head can widely reduce a weight of the head, and a center of gravity of the carbon head can be easily designed and the carbon head can be easily made large-scaled.

However, in the carbon head, the ball hitting sound is low in comparison with the head made of the metal material, and a reverberant sound is not left for a long time. Accordingly, a feeling with respect to the ball hitting sound is poor, so that the ball hitting sound can not give, for example, the impression that the ball well flies to the player.

SUMMARY OF THE INVENTION

The present invention is made in view of the above circumstances, and an object of the present invention is to provide a golf club head capable of improving a feeling by making a ball hitting sound high while achieving an excellent performance such as a vibration absorbability, a weight saving and the like by mainly employing a fiber reinforced resin.

In accordance with the present invention, there is provided a golf club head made of a fiber reinforced resin, comprising: a face hitting a ball; a crown forming an upper surface of the head; a sole forming a bottom surface of the head; a side extending between the crown and the sole from an edge on a toe side of the face to an edge on a heel side through a back face; and a hosel into which a shaft is inserted, wherein the crown has a thickness of equal to or less than 2.2 mm, and includes at least partially a high elastic part made of a fiber reinforced resin reinforced by at least one kind of high elasticity fiber having a tensile elasticity modulus between 380 and 900 (GPa), and the hosel is provided with a vibration absorbent having a loss tangent tans between 0.7 and 1.5 at a temperature of 10° C. in the vicinity thereof.

The loss tangent tan δ of the vibration absorbent is a value obtained by preparing a sheet-like test piece (width: 4.0 mm, length: 30.0 mm, thickness: 1.66 mm, length of displacement portion: 20.0 mm) from the vibration absorbent and measuring this test piece by a viscoelasticity measuring device (viscoelasticity spectrometer DVA200 improved type manufactured by Shimadzu Co., Ltd.). The measurement condition is a frequency of 10 Hz, a tensile type jig, a temperature rising speed of 2° C./min, an initial strain of 2 mm and a displacement width amplitude of 12.5 μm.

Further, the tensile elasticity modulus of the fiber is measured in accordance with JIS R7601:1986 "Carbon Fiber Test Method".

Further, it is preferable that the crown includes the high elastic part and a low elastic part made of a fiber reinforced resin reinforced by a low elasticity fiber having a tensile elasticity modulus of less than 380 (GPa), and it is desirable that the high elastic part has a projected area, projected to an outer surface of the crown, of equal to or more than 50% in an entire area of the outer surface of the crown. It is desirable that the low elastic part can form the outer surface of the crown, and the high elastic part is provided inside the low elastic part.

DESCRIPTION OF THE PREFERRED EMBODIMENT

Hereinafter, description will be given of an embodiment in accordance with the present invention with reference to the accompanying drawings.

Figure 1:
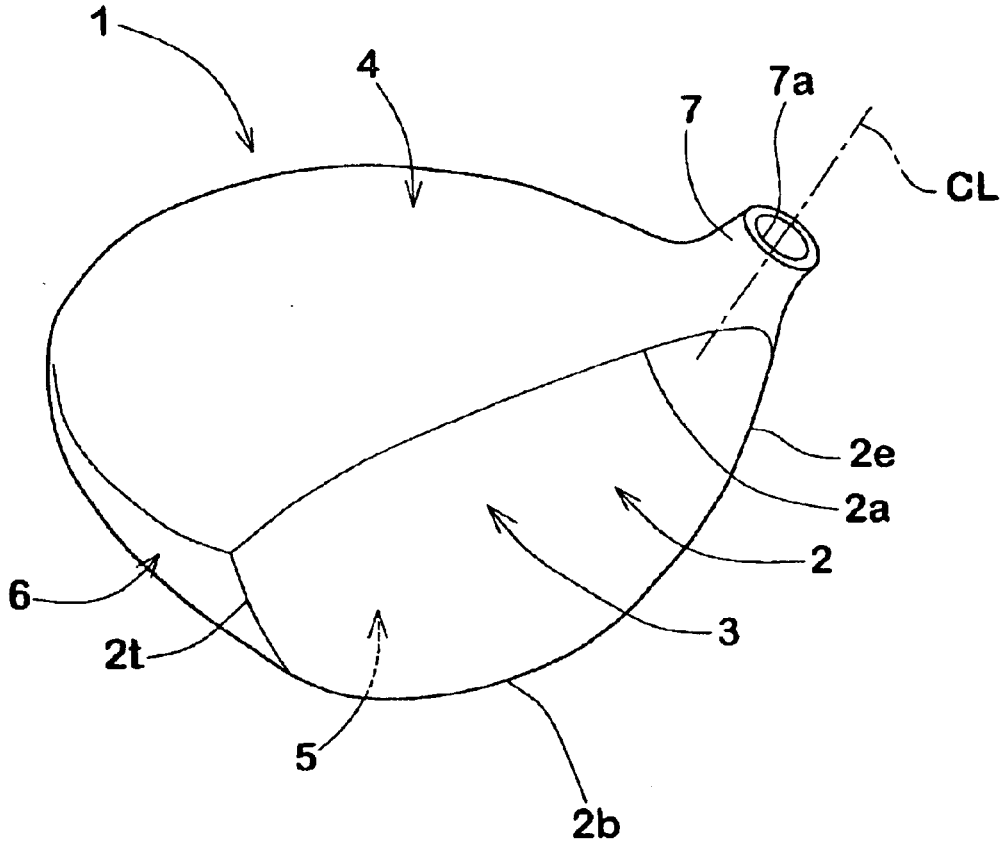
FIG. 1 is a perspective view showing an embodiment of a head in accordance with the present invention.

FIG. 1 is a perspective view showing a base state where a golf club head (hereinafter, simply referred to as "head" in some cases) 1 in accordance with the present embodiment is mounted on a horizontal surface with a prescribed lie angle and face angle. The head 1 in accordance with the present embodiment is a wood type such as a driver (#1) and the like as an example.

The head 1 comprises: a face 3 which has a face surface 2 corresponding to a surface hitting a ball as an outer surface; a crown 4 which is connected to an upper edge 2*a* of the face surface 2 and forms an upper surface of the head; a sole 5 which is connected to a lower edge 2*b* of the face surface 2 and forms a bottom surface of the head; a side 6 which joints between the crown 4 and the sole 5 and extends from an edge 2*t* on a toe side of the face surface 2 to an edge 2*e* on a heel side of the face surface through a back face; and a hosel 7 which is provided in the vicinity of a cross portion in which the face 3, crown 4 and side 6 cross on the heel side.

Figure 3:
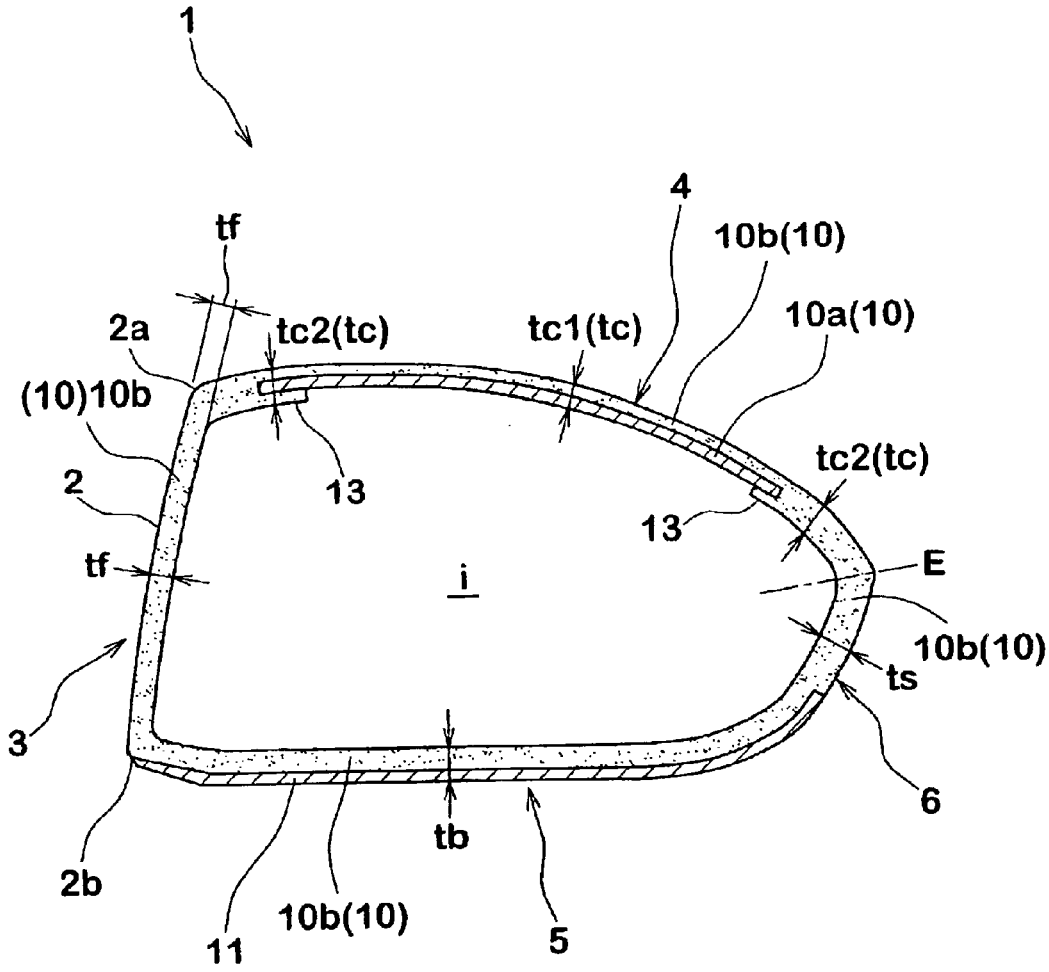
FIG. 3 is a cross sectional view taken along line A—A in FIG. 2.

A volume of the head 1 is not particularly limited; however, it is desirable that a volume equal to or more than 300 $cm^3$ is preferable, a volume between 300 and 500 $cm^3$ is further preferable, and a volume between about 370 and 460 $cm^3$ is particularly preferable. Further, it is preferable that a hollow i is formed inside the head 1 as shown in FIG. 3. The head 1 improves a ring at a time of hitting the ball on the basis of a large-scale of the volume and a hollow structure, and is help to making the hitting sound high and elongating a reverberant sound.

Further, the head 1 is made of a fiber reinforced resin. The terms "made of a fiber reinforced resin" means that the fiber reinforced resin is used in all of the components, or a main part of each component, and a metal material may be composed. In the head 1 in accordance with the present embodiment, as shown in FIG. 3, an outer covering plate 11 made of the metal material is used in the sole 5 and a part of the side 6 on the back face side. The other components, that is, the face 3 and crown 4 are entirely formed by a fiber reinforced resin 10.

Figure 4:
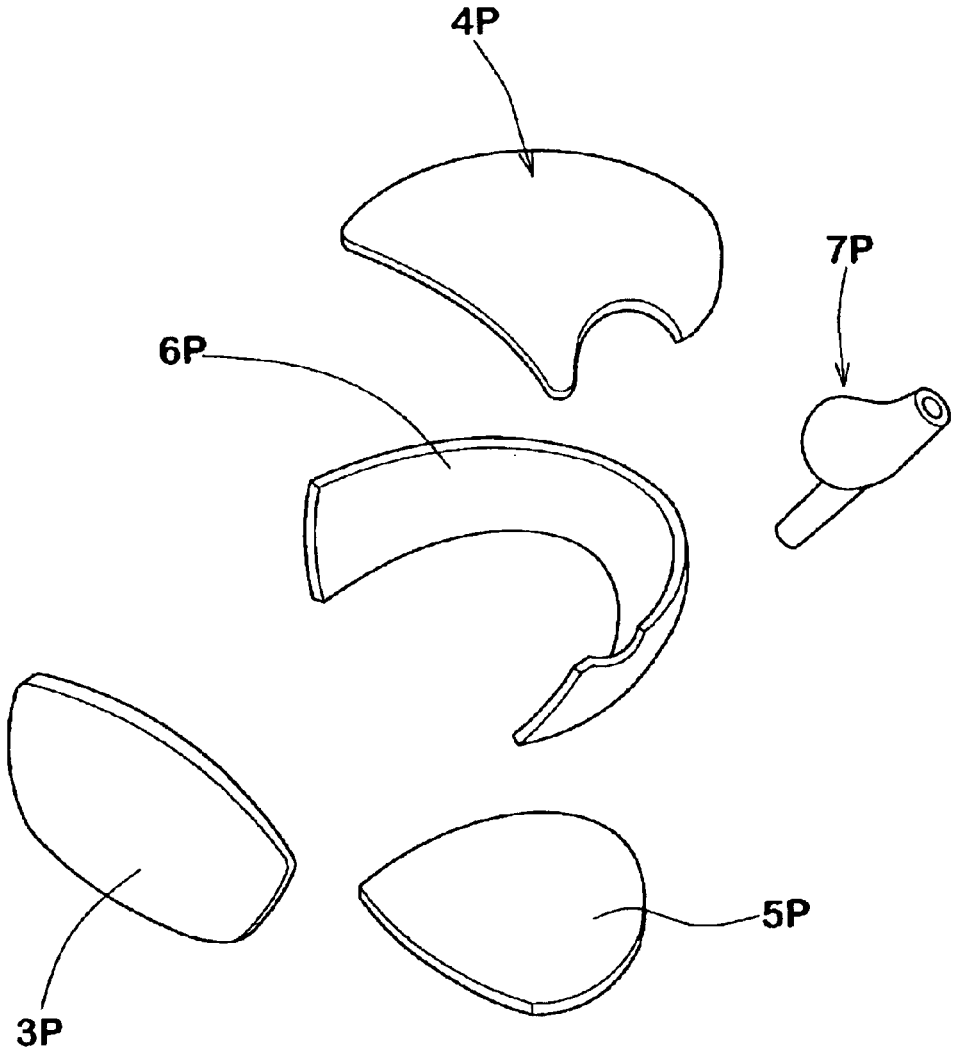
FIG. 4 is a perspective view showing an embodiment of a manufacturing method of the head.

The head 1 can be manufactured in accordance with various methods. For example, as shown in FIG. 4, the head 1 is constituted by a plurality of parts such as a face piece 3P, a crown piece 4P, a sole piece 5P, a side piece 6P and a hosel piece 7P, and can be manufactured by integrally forming these parts by using an adhesive or the like.

Further, the following processes may be employed.

Figure 5A:
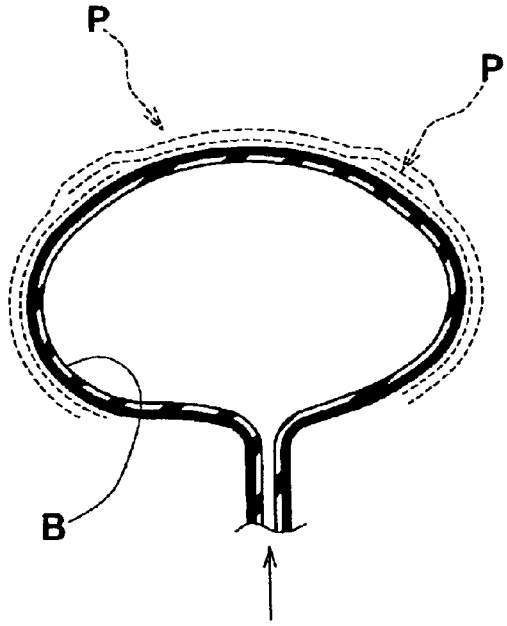
FIGS. 5A and 5B are perspective views showing another embodiment of a manufacturing method of the head.
Figure 5B:
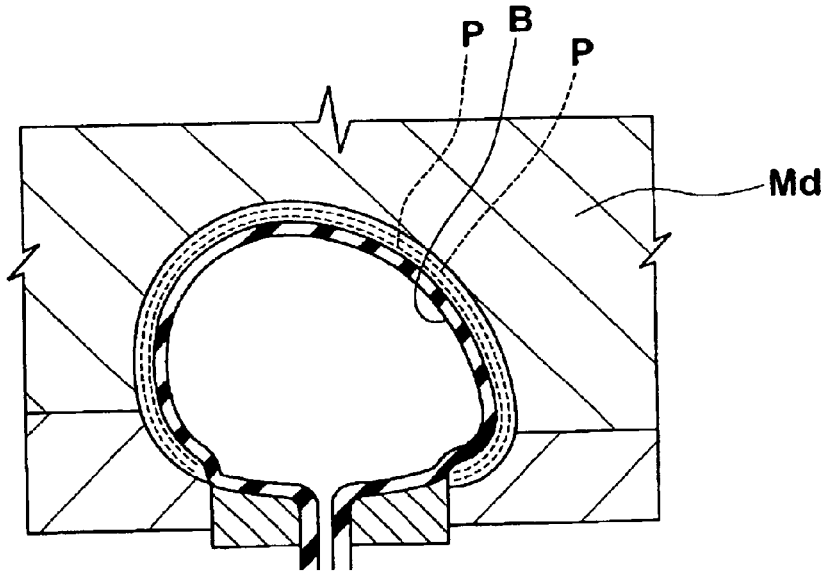

First, as shown in FIG. 5A, a prepreg P corresponding to a fiber reinforced resin sheet is attached to an outer peripheral surface of an expandable bladder B having air sealed therein. Thereafter, as shown in FIG. 5B, the bladder B is further expanded within a metal mold. The prepreg P is heated and pressurized within the heated metal mold Md so as to be molded in a main part of the head along the metal mold. In accordance with this method, even when a thickness of the prepreg P is different in each of the parts, it is possible to apply the pressure in a balanced manner by making the bladder B to freely deform. Although not shown, it is possible to mold by directly injecting a resin matrix and a compound material obtained by mixing a fiber and the other required compounding agents therein into a metal mold using a core cylinder. In other words, the manufacturing method is not particularly limited.

As shown in FIG. 3, the head 1 in accordance with the present invention is structured such that a thickness Tc of the crown 4 is setted to be equal to or less than 2.2 mm, and a high elastic part 10*a* made of a fiber reinforced resin reinforced by at least one kind of high elasticity fiber having a tensile elasticity modulus between 380 and 900 (GPa) is included at least in a part thereof. As a result of various experiments made by the present inventors, it has been found that it is important to structure the crown 4 occupying a comparatively wide area to be easily vibrated by hitting the ball, in order to obtain a high pitched ball hitting sound such as a sound obtained by the metal head by using the head made of the fiber reinforced resin. In order to make the crown 4 to be easily vibrated, it is effective to limit a thickness tc of the crown 4 to a fixed range and to form at least a part thereof harder.

It is desirable that the thickness tc of the crown 4 is equal to or less than 2.2 mm, preferably between 1.0 and 2.2 mm, and more preferably between 1.4 and 2.0 mm. When the thickness tc is larger than 2.2 mm, it is hard to make the crown 4 to vibrate at a time of hitting the ball, and it is hard to make the ball hitting sound high. Further, it is not particularly limited; however, when the thickness tc is smaller than 1.0 mm, a strength of the crown 4 tends to be lowered and a durability tends to be deteriorated. Further, the crown 4 is an area from a position in which the maximum thickness tf of the face 3 is apart from the upper edge 2*a* to the back face side up to a boundary E with respect to the side 6.

As shown in FIG. 3, the crown 4 in accordance with the present embodiment is shown by an aspect in which a thickness tc1 of a center portion is set to be smaller than a thickness tc2 of both end portions thereof (on the face surface 2 side and the back face side). Further, both of the thickness tc1 and tc2 are set to be equal to or less than 2.2 mm. In the case that the thickness of the center portion of the crown 4 is made smaller as in this embodiment, it is possible to locally reduce the rigidity of the center portion corresponding to an antinode of amplitude at a time of vibrating, so that it is effective to make the crown 4 to more easily vibrate. Further, making the crown 4 thin is useful for positioning a center of gravity of the head lower, as an incidental effect. The head that the center of gravity is made low as mentioned above, reduces a backspin amount of the ball and increases a carry.

Further, the crown 4 is provided with the high elastic part 10*a* made of the fiber reinforced resin reinforced by the high elasticity fiber having the tensile elasticity modulus between 380 and 900 (GPa) at least in a part thereof. The high elastic part 10*a* sets the crown 4 to be easily vibrated in accordance with a synergetic effect of the small thickness of the crown 4. Further, it moves a vibration frequency at a time of hitting the ball to a high frequency side, and elongates the reverberant sound while making the ball hitting sound higher.

When the tensile elasticity modulus of the fiber in the high elastic part 10*a* is less than 380 GPa, the ball hitting sound becomes low, and the feeling tends to be deteriorated. On the contrary, when it exceeds 900 GPa, a practical strength becomes low even if the elasticity modulus is high, and the durability of the crown 4 is lowered. It is particularly preferable that the tensile elasticity modulus of the fiber in the high elastic part 10*a* is set between 450 and 835 GPa, more suitably between 490 and 790 GPa.

As the high elasticity fiber, a carbon fiber is preferable, for example, HRX series "HR40" manufactured by Mitsubishi Rayon Co., Ltd. (tensile elasticity modulus: 382 GPa), "M46J" manufactured by Toray Co., Ltd. (tensile elasticity modulus: 436 GPa), YS-80 manufactured by Nippon Graphite Co., Ltd. (tensile elasticity modulus: 784 GPa) or the like is preferable. These high elasticity fibers are impregnated with a thermosetting resin in a state of being aligned in a woven fabric shape or in a fixed direction, thereby structuring a sheet-like prepreg. The high elastic part 10*a* is formed by cutting the prepreg in a predetermined shape, and laminating and thermal hardening a required number of cut prepreg. In this case, various materials can be used for the thermosetting resin.

Figure 2:
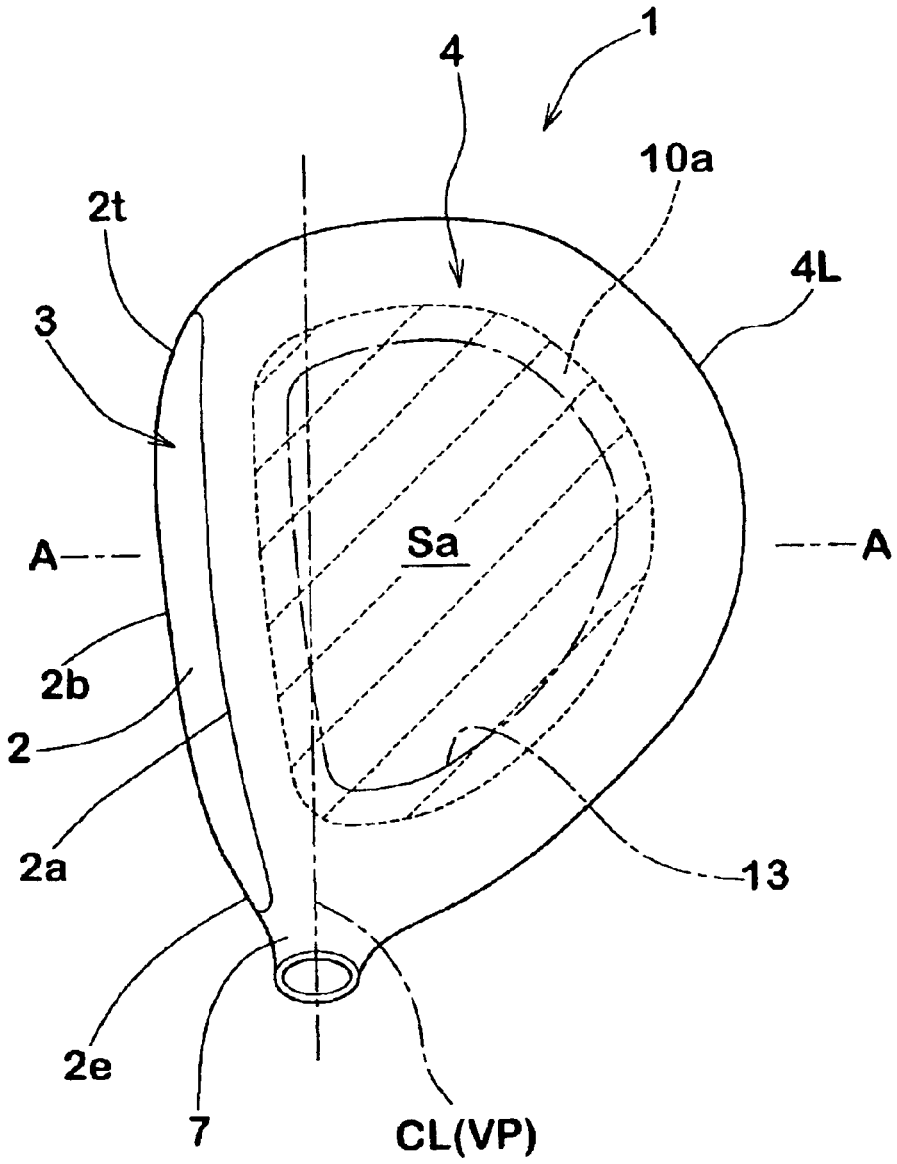
FIG. 2 is a plan view of the head.

Further, the high elastic part 10*a* tends to lower the effect of improving the ball hitting sound, when a rate occupied in the crown 4 is too small. It is preferable that a projected area Sa obtained by projecting the high elastic part 10*a* on an outer surface of the crown 4 is equal to or more than 50% in a total area S of the outer peripheral surface of the crown 4, more preferably between 60 and 100%, and further preferably between 70 and 100%. Herein, the total area S of the outer surface of the crown 4 and the projected area Sa obtained by projecting the high elastic part 10*a* on the outer surface of the crown 4 are determined from a flat surface comprehended in a plan view under a base state of the head 1, as shown in FIG. 2, as a matter of convenience. Further, the total area S of the outer surface of the crown 4 is calculated so as to include the hosel 7 (that is, corresponds to a portion except respective areas of the face surface 2 and the upper face of the hosel 7 from FIG. 2).

Figure 6A:
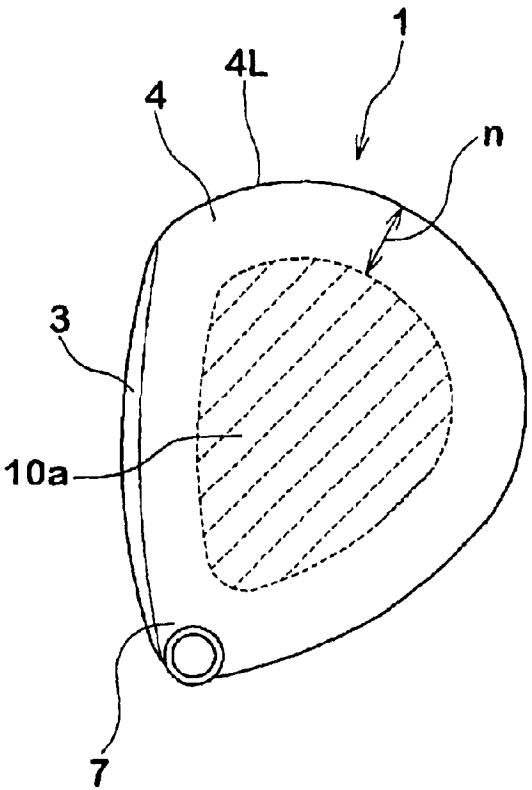
FIGS. 6A to 6C are plan views of heads in accordance with various embodiments each of which employs different high elastic parts.
Figure 6B:
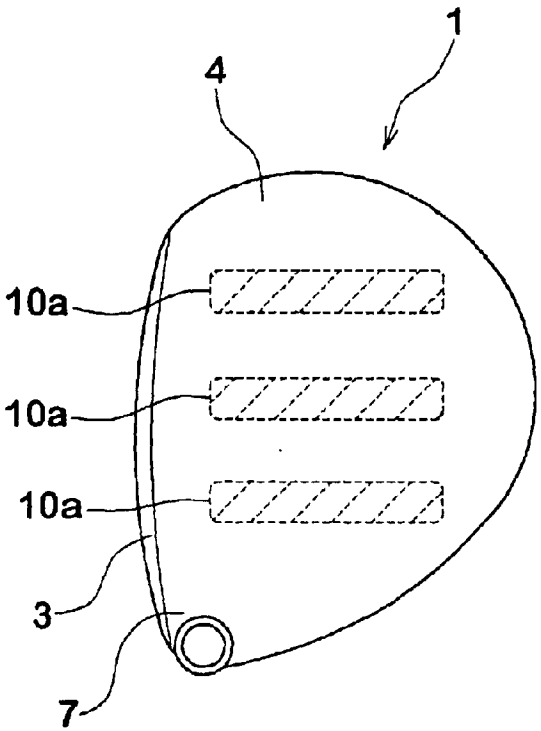
Figure 6C:
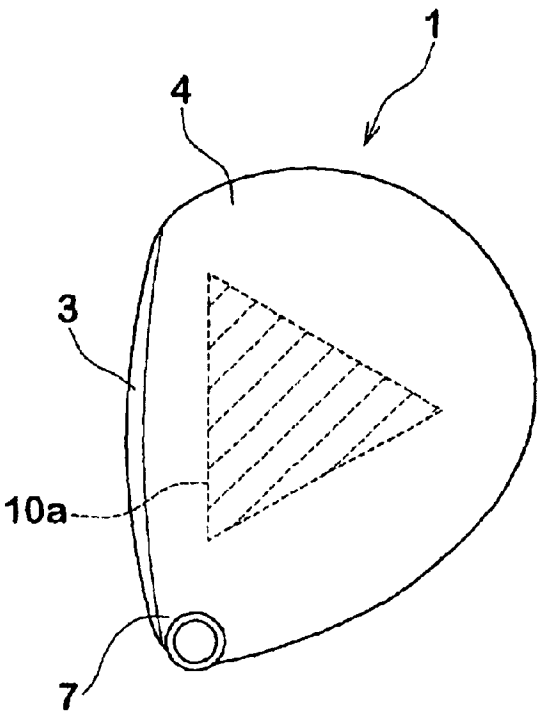
Figure 7A:
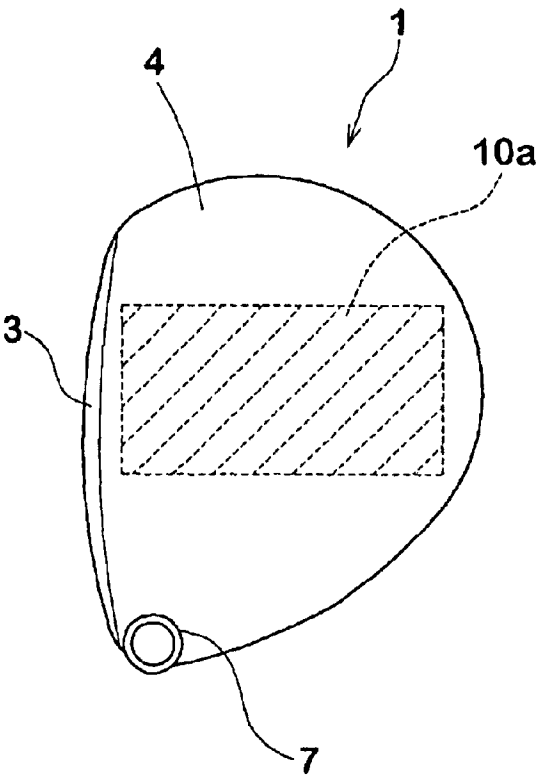
FIGS. 7A to 7C are plan views of heads in accordance with various embodiments each of which employs different high elastic parts.
Figure 7B:
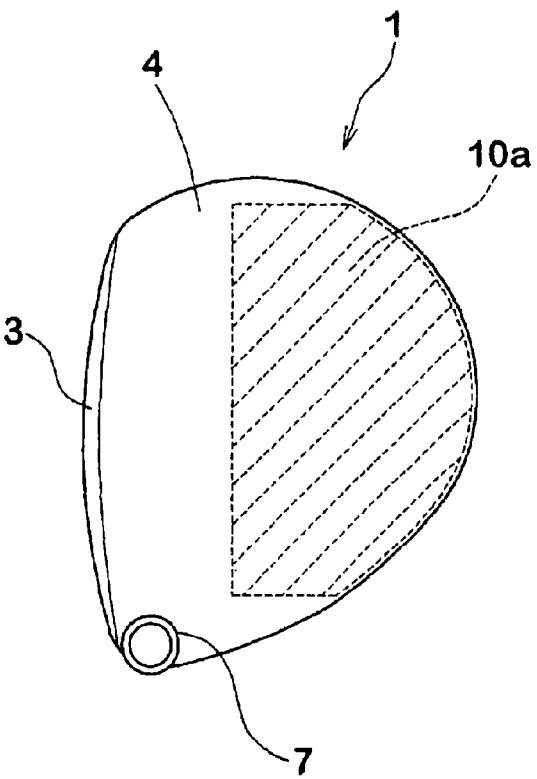
Figure 7C:
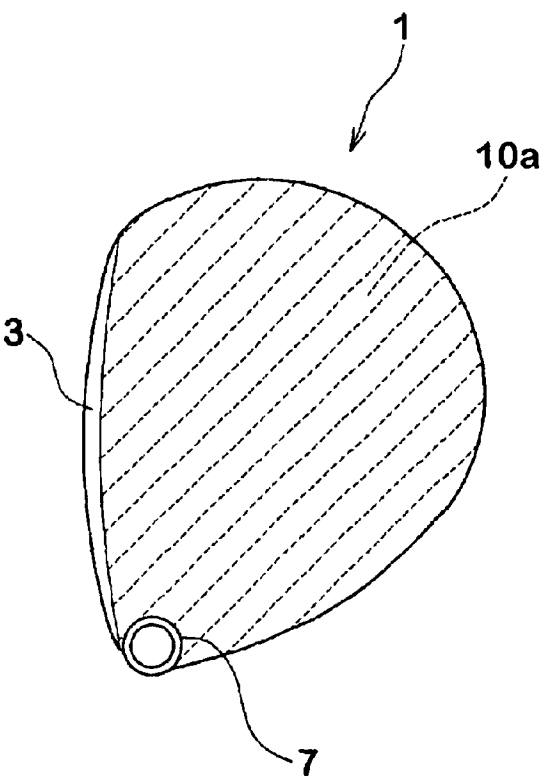

A profile shape of the high elastic part 10*a* is not particularly limited; however, it is preferable that the profile shape is a shape similar to a crown profile that an approximately fixed distance n is apart from a profile line 4L of the crown 4 toward an inner side of the head, as shown in FIGS. 2 and 6A. This is useful for making it easier to transmit the vibration of sound and improving the ball hitting sound. However, the present invention is not limited to the aspect mentioned above. It is of course possible to employ: an aspect that the high elastic part 10*a* is formed by one piece of a plurality of separated pieces (rectangular pieces of which longitudinal directions are arranged along a direction between the face and the back face in this embodiment), as shown in FIGS. 6B and 7A; an aspect that it is formed in a triangular shape as shown in FIG. 6C; an aspect that it is formed closed to the back face side of the crown 4 as shown in FIG. 7B; and an aspect that it is formed in an entire area of the crown 4 as shown in FIG. 7C.

Further, the crown 4 in accordance with the present embodiment has a structure including the high elastic part 10*a* and a low elastic part 10*b*, as shown in FIG. 3. The low elastic part 10*b* is formed by a fiber reinforced resin reinforced by a low elasticity fiber having the tensile elasticity modulus of less than 380 (GPa). Examples of the low elasticity fiber include a carbon fiber (PAN system or pitch system), a glass fiber and the like. When the tensile elasticity modulus of the low elasticity fiber is too small, the durability of the head 1 tends to be deteriorated, so that the tensile elasticity modulus is preferably between 49 and 323 GPa, more preferably between 98 and 294 GPa, and further preferably between about 147 and 235 GPa.

Herein, the crown 4 can be structured only by the high elastic part 10*a*; however, it is desirable that the low elastic part 10*b* is included in the crown 4 as in the present embodiment. Since the low elasticity fiber generally has a higher strength than the high elasticity fiber, the head mentioned above is useful for improving the durability.

Further, in the present embodiment, there is shown the aspect that the low elastic part 10*b* forms the outer surface of the crown 4, and the high elastic part 10*a* is provided inside the low elastic part 10*b*. This aspect prevents the high elastic part 10*a* from being much scraped by grinding at a time of coating finish, and prevents the ball hitting sound from being deteriorated. Further, the sound generated inside the head (air vibration) is maintained as the high elastic part boa exists in the inner side. Therefore, in accordance with this aspect, it is possible to make the reverberation larger.

More preferably, in order to prevent the high elastic part 10*a* from being peeled from the low elastic part 10*b*, it is desirable to support at least partial lower surface of an outer peripheral edge of the high elastic part 10*a* by a receiver 13 of the low elastic part 10*b* so as to clamp. In the present embodiment, there is shown a preferable aspect that the receiver B is provided in an entire periphery of the high elastic part 10*a*, as shown by an alternate long and short dash line in FIG. 2.

Figure 8:
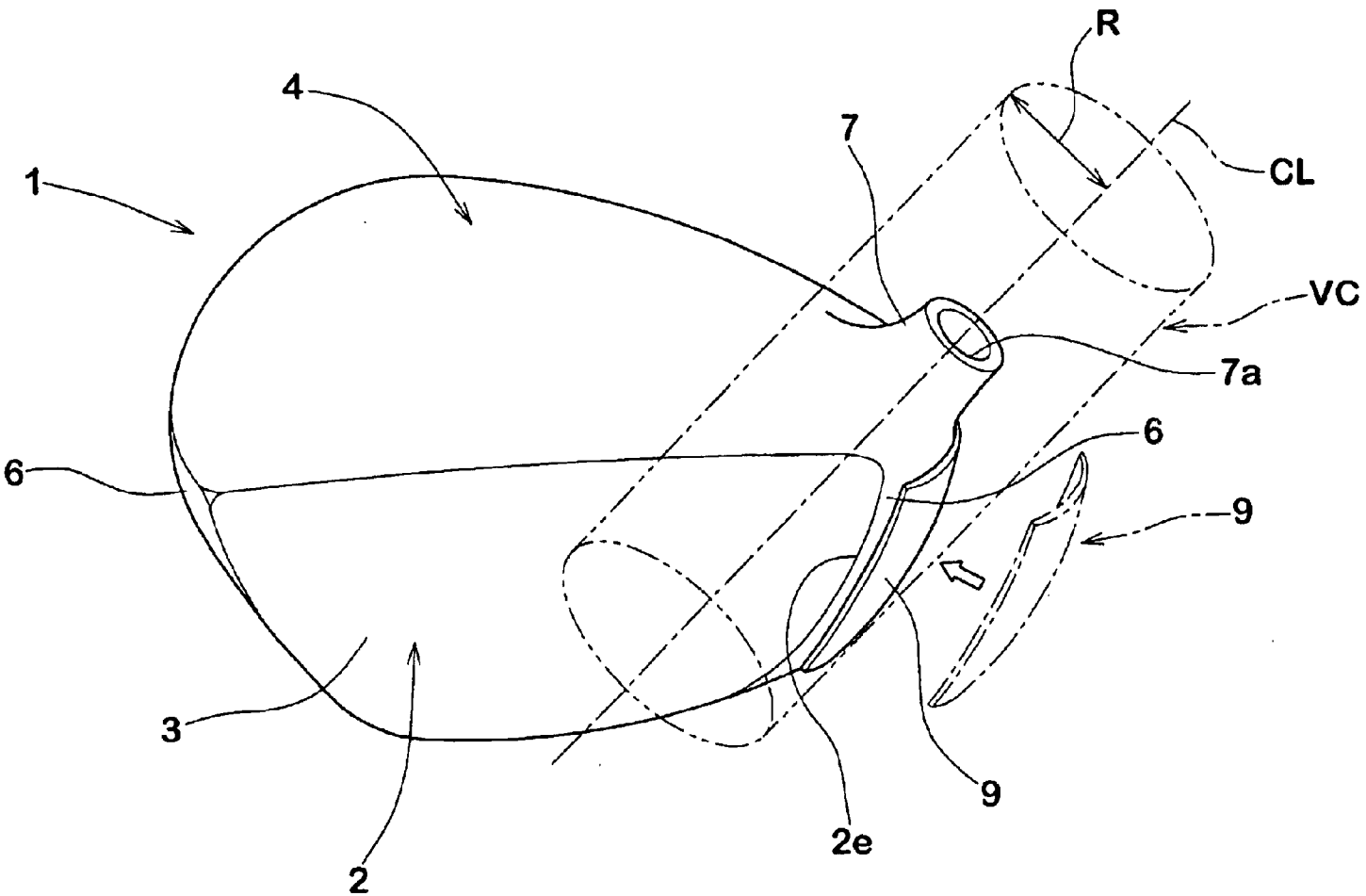
FIG. 8 is a diagram describing a portion in the vicinity of a hosel.

Further, the head 1 is provided with a vibration absorbent 9 having a loss tangent tans between 0.7 and 1.5 at a temperature of 10° C. in the vicinity of the hosel 7, as shown in FIG. 8. In the case that the ball is hit by the golf club, the impact force is transmitted to arms of a player from a portion in the vicinity of the hosel 7 via a shaft. Above all, in the head 1 in accordance with the present invention, since the crown 4 is largely vibrated for making the ball hitting sound high although the vibration itself is small in comparison with the metal head, it is considered that a vibration transmitting amount to the arms of the player is relatively increased. In accordance with the present invention, since the vibration absorbent 9 capable of absorbing the vibration is arranged in the vicinity of the hosel 7, it is possible to inhibit the vibration at a time of hitting the ball from being transmitted to the shaft, by extension to the arms of the player. Further, since the vibration absorbent 9 is provided in the vicinity of the hosel 7, it is possible to absorb the vibration in a stage that the vibration of the crown 4 is going to be transmitted to the shaft, without preventing the vibration of the crown 4 generated at a time of hitting the ball. Therefore, the head 1 in accordance with the present invention can effectively achieve both the ball hitting sound and the ball hitting feeling.

The portion in the vicinity of the hosel 7 includes a portion included in a virtual columnar body VC having a center set in an axial center line CL of a shaft insertion hole 7*a* formed in the hosel 7 and having a radius R of 35 mm. An effective vibration absorbing effect can be obtained by providing the vibration absorbent 9 in this portion. On the other hand, when the vibration absorbent 9 is arranged in an outer side thereof, the vibration of the crown 4 at a time of hitting the ball tends to be prevented. Further, in the present embodiment, as shown in FIG. 8, the vibration absorbent 9 is formed in a sheet shape having a small thickness, and is arranged in the side 6 in the vicinity of the edge 2*e* on the heel side. The vibration absorbent 9 may be exposed to the outer surface of the head 1, or may be preferably arranged on an inner surface facing a hollow i of the side 6. It is particularly preferable that it is inserted into an inner portion between the fiber reinforced resin layers constituting the side 6.

The vibration absorbent 9 is not particularly limited in the shape or the like as far as the loss tangent tan δ at the temperature of 10° C. is between 0.7 and 1.5. The loss tangent tans is a rough standard of a vibration absorbability. The larger the loss tangent tan δ is, the more a capacity of converting the vibration energy into the heat energy is excellent. When the loss tangent tan δ is less than 0.7, it is impossible to effectively reduce the impact at a time of hitting the ball. On the contrary, when it exceeds 1.5, the impact can be easily absorbed, but the hardness of the vibration absorbent is lowered. Accordingly, the strength tends to be lowered. The loss tangent tans of the vibration absorbent 9 is preferably between 0.7 and 1.2, and further preferably between 1.0 and 1.2.

Further, the loss tangent tans of the vibration absorbent 9 is based on a value at the temperature of 10° C. This is because the play in winter season is assumed. In other words, the vibration transmitted to hands is sensitive in the winter season in comparison with the summer season. Therefore, the loss tangent tan δ is based on the value at the temperature of 10° C., whereby an optimum vibration absorbing effect can be achieved in the winter air temperature.

Further, taking into consideration an installing property, a mounting property and the like to the head 1, the vibration absorbent 9 formed in the sheet shape is particularly preferable. As a particular example thereof, it is possible to preferably employ: Dipolgy Film using an electric dipole converting material manufactured by CCI Co., Ltd.; "Elastage" in which a thermoplastic elastomer and a polypropylene are mixed at a predetermined blending rate manufactured by Tosoh Co., Ltd.; "Lavaron" manufactured by mitsubishi Chemical Co., Ltd.; "Hybrer" manufactured by Kuraray Co., Ltd. or the like. The Dipolgy Film is a sheet-like structure containing the electric dipole converting material in a high polymer material, and is structured such that when a vibration energy is applied, the electric dipole moves in correspondence to movement of a high polymer chain, and the electric dipoles attracted till then are separated from each other. The separated electric dipoles are again attracted to each other so as to move to return to the original stable state; however, they are in contact with the high polymer chain or the other electric dipoles at this time, thereby converting the vibration energy into a lot of heat energy as a friction heat so as to absorb the impact. Herein, the vibration absorbent 9 is not particularly limited; however, since the vibration absorbing effect tends to be short when that the vibration absorbent 9 is too little, an surface area of the vibration absorbent 9 is between about 100 and 400 $mm^2$, and more preferably between about 150 and 300 $mm^2$.

In the present invention, on the basis of the structure mentioned above, the head mainly employing the fiber reinforce resin can achieve both of the high-pitched hitting sound and the excellent ball hitting feeling having the reduced impact applied to the arms of the player. In this case, it is more preferable to set the face 3, sole 5, side 6 and the like as follows.

First, it is desirable that the face 3 is formed to have a thickness tf between about 2.0 and 8.0 mm. When the thickness tf is less than 2.0 mm, the strength is lowered and the durability tends to be deteriorated. On the contrary, when it exceeds 8.0 mm, a repulsion property of the face 3 is lowered and the carry of the hit ball tends to be deteriorated. In particularly preferable, it is set between 3.0 and 5.0 mm. Herein, the thickness of the face 3 may be fixed, or the repulsion property can be increased by making only the peripheral edge portion thin. Herein, the face 3 in accordance with the present embodiment is shown by a preferable aspect that an entire thereof is formed by the fiber reinforced resin 10.

As mentioned above, the sole 4 has a structure including the outer covering plate 11 which forms the outer surface of the sole and is made of the metal material, and the fiber reinforced resin 10 arranged in the inner side thereof. Since the sole 4 tends to be in contact with the ground surface, providing the outer covering plate 11 mentioned above is useful for improving an external damage resistance and a durability of the head. Further, a high specific gravity of the metal material is useful for setting the center of gravity of the head lower. Various metal materials can be used for the outer covering plate 11. It is possible to effectively use, for example, a titanium alloy, SUS630, the other stainless steels, an aluminum alloy and the like.

Further, it is preferable that the sole 5 is formed to have the entire thickness tb of between about 2.0 and 5.0 mm. When the thickness tb is less than 2.0 mm, the strength is lowered and the durability tends to be deteriorated. On the contrary, when it exceeds 5.0 mm, the weight of the head tends to be increased. In particularly preferable, it is desirable to set the thickness between 2.5 and 3.5 mm.

Further, the side 6 has a structure that the main part is formed of the fiber reinforced resin 10, and a part of the back face is covered by the outer covering plate 11. It is preferable that the side 6 is formed to have a thickness ts between about 3.0 and 7.0 mm. When the thickness tb is less than 3.0 mm, the strength is lowered and the durability tends to be deteriorated. On the contrary, when it exceeds 7.0 mm, the weight of the head is increased and the vibration of the head at a time of hitting the ball tends to be reduced.

Further, in the present embodiment, the fiber reinforced resin 10 of the face 3, sole 5 and side 6 is formed as the low elastic part 10*b* made of the fiber reinforced resin reinforced by the low elasticity fiber having the high strength. Since these components contribute to the reverberant sound a little, it is desirable that these components are formed by the low elasticity fiber and the head strength is secured.

EXAMPLES

A golf club head having the basic aspect shown in FIGS. 1 to 3 and having a head volume of 360 $cm^3$ was manufactured by way of trial on the basis of the specification shown in Table 1, and the ball hitting sound (high or low of the sound) and the ball hitting feeling (large or small of the vibration transmitted to the hands) were evaluated. Herein, the main part of the head was manufactured by attaching the prepreg to the outer peripheral surface of the bladder and hot pressing within the metal mold. Herein, the vibration absorbent was arranged inside the side by inserting into the position between the prepreg layers forming the side and the position shown in FIG. 8.

Further, the ball hitting sound and the vibration at a time of hitting the ball (the impact absorbability) were evaluated on the basis of a five-point method (the larger the numeric value is, the higher the sound is and the lower the vibration applied to the arms is) in accordance with a sensory test of each of fifty general golfers, who actually hit the balls, and an average value thereof was shown. Results of the tests are shown in Tables 1-1 and 1-2, and details of the fibers are shown in Table 2.

TABLE 1-1

| | Comparative Example 1 | Comparative Example 2 | Comparative Example 3 | Comparative Example 4 | Example 1 | Example 2 | Example 3 |
|---|---|---|---|---|---|---|---|
| Position of high elastic part (Figure showing shape) | Crown FIG. 7C | Crown FIG. 7C | Sole — | Crown FIG. 7C | Crown FIG. 7C | Crown FIG. 7C | Crown FIG. 7C |
| Fiber of high elastic part | *1 | *2 | *2 | *2 | *3 | *2 | *4 |
| Tensile elasticity modulus of fiber in high elastic part [GPa] | 235 | 784 | 784 | 784 | 490 | 784 | 451 |
| Thickness tc of crown [mm] | 1.8 | 1.8 | 1.8 | 2.5 | 1.8 | 1.8 | 1.8 |

TABLE 1-1-continued

| | Comparative Example 1 | Comparative Example 2 | Comparative Example 3 | Comparative Example 4 | Example 1 | Example 2 | Example 3 |
|---|---|---|---|---|---|---|---|
| Ratio between area S of outer surface of crown and area Sa of high elastic part (Sa/S) [%] | 100 | 100 | — | 100 | 100 | 100 | 100 |
| Material of vibration absorbent | a | b | a | a | a | a | c |
| Loss tangent of vibration absorbent tanδ | 1.2 | 0.4 | 1.2 | 1.2 | 1.2 | 1.2 | 0.7 |
| Test results | | | | | | | |
| Ball hitting sound (average of five-point method) | 1.9 | 4.5 | 1.5 | 2.5 | 4.2 | 5.0 | 3.7 |
| Ball hitting feeling (average of five-point method) | 4.2 | 2.1 | 4.2 | 3.5 | 5.0 | 5.0 | 3.5 |

TABLE 1-2

| | Example 4 | Example 5 | Example 6 | Example 7 | Example 8 | Example 9 | Example 10 |
|---|---|---|---|---|---|---|---|
| Position of high elastic part (Figure showing shape) | Crown FIG. 7C | Crown FIG. 7C | Crown FIG. 6A | Crown FIG. 6B | Crown FIG. 6C | Crown FIG. 7A | Crown FIG. 7B |
| Fiber of high elastic part | *2 | *2 | *2 | *2 | *2 | *2 | *2 |
| Tensile elasticity modulus of fiber in high elastic part [GPa] | 784 | 784 | 784 | 784 | 784 | 784 | 784 |
| Thickness tc of crown [mm] | 0.8 | 1.8 | 1.8 | 1.8 | 1.8 | 1.8 | 1.8 |
| Ratio between area S of outer surface of crown and area Sa of high elastic part (Sa/S) [%] | 90 | 80 | 60 | 55 | 62 | 65 | 75 |
| Material of vibration absorbent | a | a | a | a | a | a | a |
| Loss tangent of vibration absorbent tanδ | 1.2 | 1.2 | 1.2 | 1.2 | 1.2 | 1.2 | 1.2 |
| Test results | | | | | | | |
| Ball hitting sound (average of five-point method) | 5.0 | 4.6 | 3.8 | 3.2 | 4.0 | 4.2 | 4.4 |
| Ball hitting feeling (average of five-point method) | 5.0 | 4.5 | 4.2 | 4.1 | 4.0 | 4.1 | 4.1 |

TABLE 2

| | Maker | Kind of fiber | Tensile elasticity modulus | Tensile strength |
|---|---|---|---|---|
| *1 | Manufactured by Nippon Graphite Fiber Co., Ltd. | YS-80 | 784 GPa (80 t) | 3528 Mpa |
| *2 | Manufactured by Nippon Graphite Fiber Co., Ltd. | YS-60 | 617 GPa (63 t) | 3528 Mpa |
| *3 | Manufactured by Toray Co., Ltd. | M46J | 436 GPa (44.5 t) | 4214 Mpa |
| *4 | Manufactured by Mitsubishi Rayon Co., Ltd. | HR40 | 392 GPa (40 t) | 4606 Mpa |

<Materials of Vibration Absorbent> a: "Dipolgy Film" manufactured by CCI Co., Ltd. (thickness: 0.2 mm×longitudinal: 30 mm×transversal: 15 mm)

b: "High Milan 1652" manufactured by Mitsui Du Pont Chemical Co., Ltd.

c: Mixture obtained by mixing "Hybrer" manufactured by Kuraray Co., Ltd. and polypropylene by a rate 70:30

As a result of the test, it is confirmed that the head in accordance with each example improves the ball hitting sound while maintaining the impact absorbability.

As mentioned above, in accordance with the present invention, since the thickness of the crown is limited to the fixed range and a part of the crown is provided with the high elastic part made of the fiber reinforced resin reinforced by at least one kind of the high elasticity fiber having the tensile elasticity modulus between 380 and 900 GPa, in the golf club head employing the fiber reinforced resin, it is possible to structure the crown thin and hard. Therefore, it is possible to make the ball hitting sound high and it is possible to generate the reverberant sound for a long time, by efficiently vibrating the crown at a time of hitting the ball. Further, a major part of the vibration mentioned above is absorbed by the vibration absorbent provided in the vicinity of the hosel and having the large loss tangent tan δ before being transmitted to the shaft. Accordingly, it is possible to reduce the vibration transmission to the arms of the player. As mentioned above, the golf club head in accordance with the present invention can preferably improve the ball hitting sound while maintaining the impact absorbability, and can improve the feeling.

What is claimed is:

1. A golf club head made of a fiber reinforced resin, comprising:

a face hitting a ball;

a crown forming an upper surface of the head;

a sole forming a bottom surface of the head;

a side extending between the crown and the sole from an edge on a toe side of the face to an edge on a heel side through a back face; and a hosel into which a shaft is inserted, wherein the crown has a thickness of equal to or less than 2.2 mm, and includes at least partially a high elastic part made of a fiber reinforced resin reinforced by at least one kind of elasticity fiber having a tensile elasticity modulus between 380 and 900 (GPa), and the hosel is provided with a vibration absorbent having a loss tangent tan δ between 0.7 and 1.5 at a temperature of 10° C. in the vicinity thereof.

2. The gold club head according to claim 1, wherein the crown includes the high elastic part and a low elastic part made of a fiber reinforced resin reinforced by a low elasticity fiber having a tensile elasticity modulus of less than 380 (GPa), and the high elastic part has a projected area, projected to an outer surface of the crown, of equal to or more than 50% in an entire area of the outer surface of the crown.

3. The golf club head according to claim 2, wherein the low elastic part forms the outer surface of the crown, and the high elastic part is provided inside the low elastic part.

4. The gold club head according to any of claims 1 to 3, wherein the vibration absorbent is formed in a sheet shape and is arranged on the heel side of the side.

5. The gold club head according to claim 2 or 3, wherein at least partial lower surface of an outer peripheral edge of the high elastic part is supported by a receiver constituted by a low elastic part.

6. The golf club head according to claim 1, wherein the sole includes an outer covering plate which forms an outer surface of the sole and is made of a metal material, and a fiber reinforced resin arranged inside the sole.

7. The golf club head according to claim 1, wherein the crown has a thickness tc1 of a center portion smaller than a thickness tc2 on the face side and on the back face side.

8. The golf club head according to claim 1, wherein a profile shape of the high elastic part is a shape similar to a crown profile apart from a profile line of the crown toward an inner side of the head at an approximately fixed distance.

9. The golf club head according to claim 1, wherein the vibration absorbent has an surface area between 100 and 400 $mm^2$.

* * * * *